United States Patent [19]

Pasternack

[11] Patent Number: 4,611,589

[45] Date of Patent: Sep. 16, 1986

[54] DEVICE FOR REGENERATING RESPIRATORY BREATHING AIR

[75] Inventor: Adalbert Pasternack, Bad Schwartau, Fed. Rep. of Germany

[73] Assignee: Drägerwerk AG, Fed. Rep. of Germany

[21] Appl. No.: 681,926

[22] Filed: Dec. 14, 1984

[30] Foreign Application Priority Data

Dec. 16, 1983 [DE] Fed. Rep. of Germany ..... 3345584

[51] Int. Cl.[4] ..... A62B 7/00

[52] U.S. Cl. ..... 128/202.26; 128/204.15

[58] Field of Search ..... 128/204.15, 204.16, 128/205.27, 205.28, 206.22, 202.26, 201.21, 201.25

[56] References Cited

U.S. PATENT DOCUMENTS

| | | | |
|---|---|---|---|
| 2,581,709 | 1/1952 | Rogers | 128/204.15 |
| 3,527,214 | 9/1970 | Rio et al. | 128/204.15 |
| 3,550,588 | 12/1970 | Stahl | 128/206.22 |

*Primary Examiner*—Henry J. Recla

*Attorney, Agent, or Firm*—McGlew and Tuttle

[57] ABSTRACT

In the regeneration cartridges used in respirators for carbon dioxide adsorption, heat and water are released. Especially the heat becomes a burden for the user. It must, therefore, be removed. To this end, a regenerant of the cartridge is followed by a cooling device which contains a coolant, e.g. water ice. The cooling device comprises a threaded member which is screwed into a screwthread type recess of the cartridge container. The breathing air then sweeps the cooling device in thermal contact in a spiral channel formed between the wall of the container and the insert and terminating in an outlet, as it cools the breathing air. The condensation collects at the lower point of the channel, where there is a spring-loaded drain valve, and when the valve has opened, it drains to the outside under the force of the positive respiratory pressure and a collecting condensate water column.

4 Claims, 1 Drawing Figure

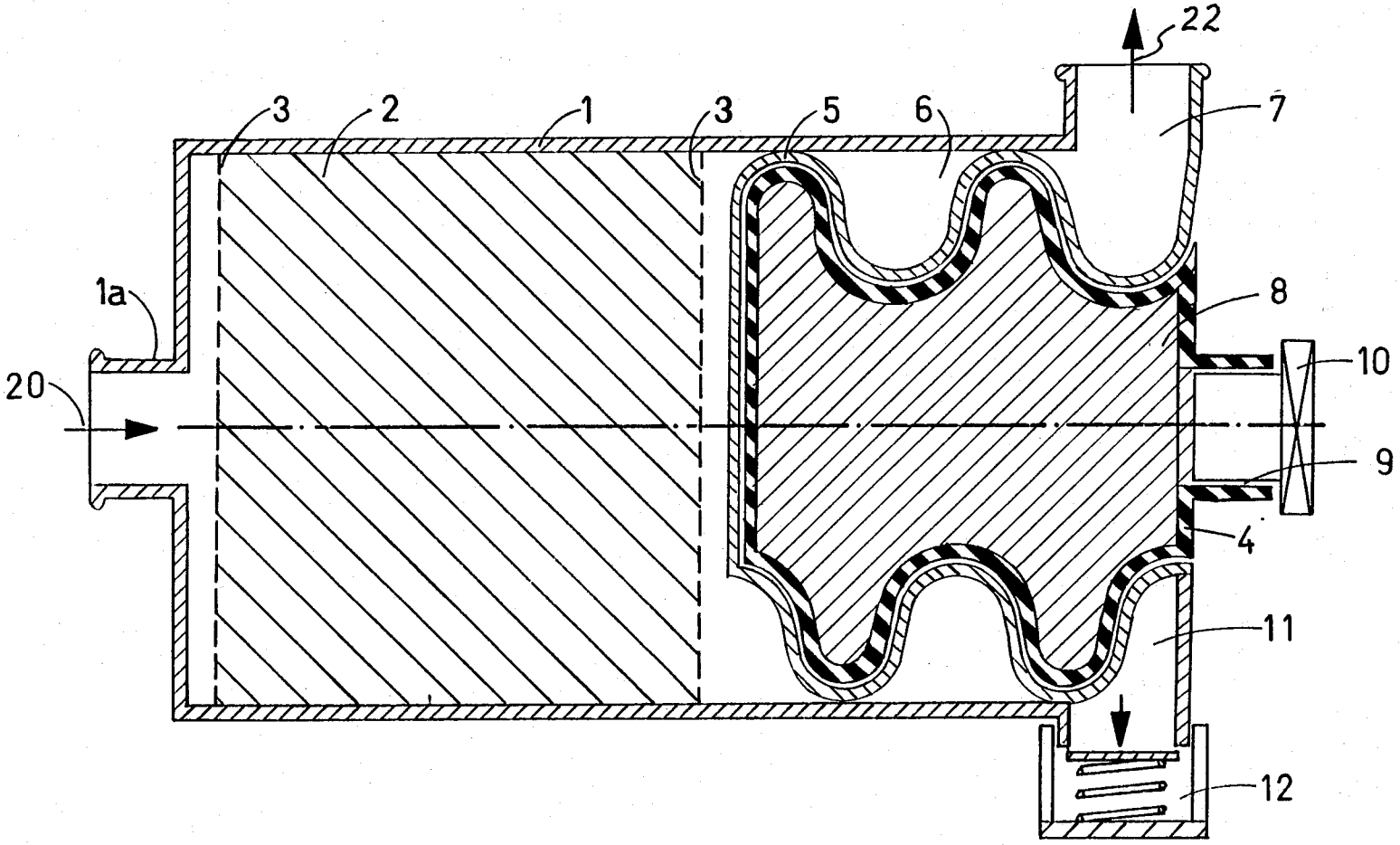
22
7
8
10
9
4
11
12
6
5
3
1
2
3
1a
20

DEVICE FOR REGENERATING RESPIRATORY BREATHING AIR

BACKGROUND OF THE INVENTION

1. Field of the Invention

This invention relates, in general, to respirating devices and, in particular, to a new and useful device for regenerating respiratory breathing air.

A regenerating cartridge is known from German Utility Model DE-GM No. 19 57 176 "Respirator". In cycle respirators, one uses for regeneration of the breathing air a carbon dioxide absorption cartridge, which is generally filled with an absorbant on the basis of alkali hydroxide or lime. As carbon dioxide is being absorbed, heat and water are released. Especially, the heat, if not removed sufficiently, becomes unbearable for the user of the respirator in that it increases the temperature of the breathing air. To avoid this, it is known practice to cool the regenerating cartridge.

The known regenerating cartridge of the "Respirator" according to DE-GM No. 15 57 176 contains the carbon dioxide absorbant and downstream thereof the coolant in a common container. The smaller container separated from the latter, intended to receive the coolant, is designed and arranged in such a way that the exhaled air leaving the regenerant must flow over as large as possible a contact area with the coolant. For this purpose, it may be provided with cooling fins. The cooling device after the regeneration section may be arranged below or laterally of the regenerating action. The condensation should occur in the region of the coolant. It is not removed from the respiratory cycle. The chemicals must laboriously be introduced through individual openings and removed.

SUMMARY OF THE INVENTION

The invention comprises a regenerating cartridge with a cooling device for respirators in a simple design which permits installation of the cooling device only when needed and in which the condensation does not cause disturbances.

According to the invention, a cooling device containing the coolant is screwed into a screwthread type receiving recess formed in a container.

The insert has a filling nipple to be closed with a stopper.

An advantage achieved with the invention is that the cooling device, through its large contact surface is in good thermal contact with the exhalation air heated in the regenerant and the device is very effective despite its simple design. It need not necessarily be installed for the regenerating cartridge to be functional. Only as need arises, it can then be installed without interruption of operation of the respirator. The cooling device itself can be handled separately and thus is easy to fill and to evacuate.

In an advantageous variant, the channel is closed at its lowest point by a spring-loaded drain valve opening in a gravity direction. The occuring water thus drains automatically. It does not hinder the user; it cannot result in reduced efficiency of the regenerant due to overwetting.

Accordingly, it is an object of the invention to provide an improved device for regenerating respiratory breathing air which comprises a container which has a flow passage therethrough from an inlet to an outlet and which includes a wall adjacent the outlet which has a recess to accommodate an insert having a coolant therein. The container of the insert advantageously comprises a threaded member which threads into the recess of the container which has the flow passage therethrough and a regenerant material therein. The cooling container may be threaded into or removed from the container having the regenerant material and the recess in the regenerant material container is located so that it defines a spiral passage between it and the side walls of the container for the flow of the respiratory air assuring that adequate cooling takes place before it is discharged through the outlet.

A further object of the invention is to provide a container with a regenerative material which also has a coolant insert associated therewith which may be readily removed or installed as desired. The construction in which a flow passage is defined through the regenerant container for the respiratory air so that it may be directed in good heat exchange contact with the coolant of the coolant container.

A further object of the invention is to provide a device for reconditioning the respiratory air which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawing and descriptive matter in which a preferred embodiment of the invention is illustrated.

BRIEF DESCRIPTION OF THE DRAWING

The only FIGURE of the drawing is a sectional view of regeneration cartridge for respiratory air having a coolant insert installed therein and constructed in accordance with the invention.

GENERAL DESCRIPTION OF THE PREFERRED EMBODIMENTS

Referring to the drawings, in particular, the invention embodied therein comprises a device for regenerating respiratory breathing air which includes a container 1 having a regenerant material 2 therein and which has an inlet 1*a* for the inflow of the breathing air in the direction of the arrow 20. The breathing air is directed through a regenerant material 2 which is held between spaced-apart screens or sieves 3. The breathing air then is directed in a flow path which extends in a spiral around the screwthread wall formation 5 in a spiral channel 6 before it exits through an outlet 7 in the direction of the arrow 22.

In accordance with the invention, a regenerating cartridge with cooling device includes a container 1 having a front portion as seen in flow direction 20, a regenerant material 2, e.g. lime. The lime 2 is arranged in a known manner between holding sieves or screens 3. In a rear portion is a cooling device or coolant holder generally designated 4.

In accordance with the invention, the cooling device 4 includes a thread-shaped insert 5, which forms an end wall of the container 1. A coiled or screwthread-shaped channel 6 is formed between container 1 and the insert 5 through which purified breathing air leaves the regeneration cartridge. The screwthread type channel 6 is shaped to cause the breathing air to flow tangentially at the circumference of the insert 5 and thus in thermal contact with a coolant 8, e.g. water or ice, of the cooling device 4 over a long flow path.

The coolant 8 is filled in through a filling nipple 9 which is closed with a stopper 10.

The cooling device 4 is screwed in only just before use, without disturbing the operation of the respirator which, if the work load permitted, could be used without the cooling device 4.

The water occurring in the reaction collects in channel 6 at the lowest point 11 above a spring-loaded drain valve 12. At sufficient positive respiratory pressure in channel 6 plus a desired water column, it discharges to the outside.

What is claimed is:

1. A device for conditioning respiratory air, comprising a container having side walls and a first end wall with a breathing gas inlet for respiratory air and an opposite end wall with an inwardly extending recess formed by a wall having course threads defining interior and exterior spiral grooves, said exterior spiral groove having an exterior surface which abuts against said side walls and which defines a spiral respiratory gas flow passage on the interior of said container between said exterior spiral grooves and said side walls, one end of said passage communicating with said container interior adjacent said inlet and an opposite end of said passage having an outlet from said container, a carbon dioxide absorbing - exothermic reacting material disposed in said container adjacent said inlet permitting flow therethrough of breathing gas from said inlet to said respiratory gas flow passage, and a coolant holder having a side wall defining course threads complimental to said interior spiral grooves which is threadably received therein.

2. A device according to claim 1, wherein the side wall opposite to the outlet of said spiral is provided with a drain and drain valve means in said drain permitting liquid draining thereof.

3. A device according to claim 1, wherein said coolant holder has an outer end with a nipple and a stopper engaged in said nipple permitting filling of said coolant holder.

4. A device ccording to claim 1, wherein said container has a low point adjacent said opposite end wall with a drain member closing said drain, and biasing means acting on said member to close said drain, said drain being openable by pressure inside said container due to the collection of condensate and the pressure of the breathing air, said regenerative material being lime.

* * * * *